US005374137A

United States Patent [19]

Steinberg

[11] Patent Number: 5,374,137

[45] Date of Patent: Dec. 20, 1994

[54] YIELDABLE POST AND METHOD OF USING SAME

[76] Inventor: Erik J. Steinberg, 3971 Big Horn Rd., Unit 7B, Vail, Colo. 81657

[21] Appl. No.: 940,584

[22] Filed: Sep. 4, 1992

[51] Int. Cl.[5] ..... E01F 9/00

[52] U.S. Cl. ..... 404/9; 404/10; 428/105; 428/107

[58] Field of Search ..... 404/9, 10, 11; 52/301; 256/11; 138/125; 428/392; 273/81 R

[56] References Cited

U.S. PATENT DOCUMENTS

| | | | |
|---|---|---|---|
| 243,696 | 7/1881 | Faloon | 256/11 |
| 3,302,347 | 2/1967 | Jackson et al. | 52/154 |
| 3,547,162 | 12/1970 | Schaerer | 138/125 |
| 3,969,853 | 7/1976 | Deike | 52/156 |
| 4,265,972 | 5/1981 | Rudner | 428/392 |
| 4,491,438 | 1/1985 | Berutti | 404/10 |
| 4,599,012 | 7/1986 | Kugler et al. | 404/10 |
| 4,636,109 | 1/1987 | Clausen et al. | 404/10 |
| 4,702,639 | 10/1987 | Hinterholzer | 404/10 |

*Primary Examiner*—Michael Powell Buiz
*Assistant Examiner*—Pamela Anne O'Connor
*Attorney, Agent, or Firm*—Hancock & Knearl

[57] ABSTRACT

A safety pole useful as a ski gate is constructed of a core of flexible, self redressing material, covered by a flexible protective mesh sleeve and capped at both ends. The core is soft and flexible enough to prevent injury to skiers, yet self redresses to its original, normally vertical position quickly and reliably. The mesh sleeve is tough and flexible, to bend with the core while protecting it from damage from skis. The end caps protect the core from damage upon insertion in the snow. By making some or all of the elements of fluorescent, brightly colored or light reflective material, or by adding reflective tape or stickers to those elements, visibility of the pole is enhanced. The pole is suitable for retaining ropes or ribbons to demarcate lift line paths, boundaries and the like.

11 Claims, 2 Drawing Sheets

YIELDABLE POST AND METHOD OF USING SAME

BACKGROUND OF THE INVENTION

1. Field of the Invention

The present invention relates to the field of static land markers and, more specifically, to yieldable posts which are particularly useful in ski areas, such as for ski gates or slalom course markers. In addition, the present invention is especially useful for safety markers, ski lift line delineators, boundary identifiers and the like.

2. Description of the Prior Art

It is known in the prior art to anchor poles in the earth by various means. For example, U.S. Pat. No. 3,969,853 by Deike discloses a torque fin ground anchor with tilted fins which is driven into the ground in a relatively permanent installation for retaining a rigid post in place. U.S. Pat. No. 3,302,347 by Jackson describes an anchor with retaining flukes which is driven into the ground but which can accommodate flexing of its main shaft.

The prior art has recognized the need for flexible ski posts to minimize injury when a skier runs into a post. Thus, some prior art has developed mechanisms to anchor a slalom pole while permitting a certain amount of flexibility to it. An example is U.S. Pat. No. 4,702,639 by Hinterholzer which discloses a rigid slalom post with a flange rotatable in a radial plane to hold the post in the snow. A degree of flexibility is obtained by interconnecting upper and lower post segments by rubber-elastic elements or bushings. However, slalom poles, as taught in Hinterholzer, are expensive to fabricate while positioning of the lower, anchored elements so they are not an additional hazard to skiers is obviously critical but difficult to maintain as snow levels change. Further, when a skier hits either of the relatively rigid post segments, there is a danger of injury to that skier.

Another example of a rigid slalom post with a single pivot point is discussed in U.S. Pat. No. 4,491,438 by Berutti. The upper and lower post segments of Berutti are interconnected by a pivot joint using a complex of discs and coaxial springs thereby demanding relatively expensive posts. In addition, Berutti likewise suffers from the disadvantages associated with the need to locate the pivot joint so that it resides in close proximity to the surface of the snow or else it hazards serious injury to the skiers, as does the rigidity of the pole elements.

A need remains in the art for a post that is safe to use as a marker throughout a ski area and which avoids the expense and safety hazards of contemporary ski poles. Furthermore, the prior art devices are not well suited to accommodating the variety of snow depths at certain parts of the year because that snow depth sometimes varies greatly. Therefore, there is a need for a more flexible post application that is relatively independent of the snow depth variations.

Still further, contemporary ski gates are awkward to use for training purposes and are not adaptable for a variety of training exercises and programs. Normally, a ski instructor, student and/or competitor must arrange availability of an existing slalom course for training. Also, contemporary slalom gates are simply not well suited for training exercises in other ski activities. Additionally, servicing a full length regulation course or performing a single trail closure within the existing art is a multiple person task placing a considerable burden on the operator carrying the prior art devices.

SUMMARY OF THE INVENTION

Ski gates, or slalom posts, simply mark the turns that a racer must make while traversing the well known down hill zig zag slalom course during a slalom race. Racers will pass as close as possible to the pole in order to save time. Often, a racer will physically contact a pole. The present invention reduces the risk of injury to the skier by providing a ski pole built of a soft, flexible but self redressing material to minimize injuries.

A ski gate or slalom pole, in accordance with the invention, is constructed to minimize the possibility of injury to the skier. This is accomplished by providing a ski gate having a flexible core or base member within a protective flexible mesh sleeve and preferably held in place by end caps. The flexible pole is self redressing, meaning that it quickly and reliably returns to its original vertical position. This objective is accomplished at much lower cost than prior devices which required complicated mechanisms to redress the poles by allowing them to bend and return to their prior position.

Safety is also enhanced because the present invention is soft and flexible throughout, preventing injuries wherever it is impacted or fallen upon. Current products tend to shatter when impacted during colder conditions (e.g., below zero Fahrenheit) as well as producing a relatively rigid, hazardous obstacle at ground level. This invention is essentially impale proof as compared to the prior art.

Ideally, a safety post or pole in accordance with this invention might take the form of a single cylindrical member constructed of a readily flexible material which not only redresses after a flexing force is removed but likewise is sufficiently tough to withstand physical abuse as from the edges of skis, vehicles and the like. Unfortunately, no single such material is known to exist.

Thus, in one embodiment of the invention, a ski gate is formed of complementary materials. For instance, a center core of a flexible, self redressing material such as 3.2 pcf (pounds per cubic foot) of special polyester foam (SPF) is fabricated and covered by a sleeve of a protective flexible mesh made from a material preferably consisting of a low density polyethylene or similar cost effective material. The core and sleeve are held in place as an assembly by end caps also of a material such as low density polyethylene.

More specifically, the ski gate comprises a non-tubular or tubular (preferably a circular or cylindrical) base core element with or without stiffeners and of a generally uniform diameter in the range of one to three inches, and from about two feet to about eight feet in axial length, covered by a mesh sleeve of a slightly larger diameter than the core, with tightly fitted end caps glued on with any commercially available glue capable of withstanding the temperature differentials of the intended environment such as a ski slope.

Another feature of the invention is for one of the end caps to have a hook or bore formed as an integral part. This allows the stringing of tape, twine, rope or the like, between the posts, for use in crowd control, as in the lift line mazes leading up to ski lifts and/or to mark off snowcats or hazardous areas.

The invention is suitable for implanting in a base for placement on hard surfaces, such as roads, pathways, or the ground. The pole thus becomes a highly visible marker which will not cause injury if impacted by a pedestrian, animal, automobile or other moving object. In most cases, the pole is placed into a drilled hole bored as by an electric or gas powered auger into the snow or earth. This retains its location while presenting little injury risk to anyone who might impact it.

Apparatus in accordance with this invention is a yieldable post suitable for use as a slalom pole or gate, safety marker, boundary indicator or the like. It is constructed with an elongated core of a flexible material capable of self redressing by returning to its elongated configuration upon removal therefrom of any force which causes flexing of that core. An elongated, hollow sleeve of a flexible material which will resist impacting by an object is configured for internally receiving the core thereby forming a protective covering over the core. The core within the sleeve is retained as an assembly whereby implantation of that assembly in a vertically retaining bore will provide a self redressing but flexible post which can withstand impact without damage thereto. End caps can provide the retention function.

The protective covering used in the post assembly is preferably formed of an open mesh. The post with end caps that have an eye formed therein as an integral element are especially useful for retaining boundary defining ropes, twine, tape or the like.

The post preferably has an overall outside diameter for snugly fitting into bores of about 1.5 inch diameter because this is the standard size of the auger used currently by ski area operators for implanting slalom pole anchors. The redressing characteristics equivalent to 3.2 pcf SPF material is particularly well suited for the core element of the post assembly. The damage preventing characteristics of the protective sleeve is obtainable by using materials such as low density polyethylene material in an open mesh pattern.

The present invention includes the process or method of providing a safe marker, or the like, for establishing a visible indicator function which includes forming a relatively straight, elongated core of a flexible, self redressing material and encasing this core in an impact resistant sleeve for protecting the core from damage upon impact while allowing return of the core to its relatively straight, elongated configuration after removal of an impact force from the external sleeve. The encased core is then implanted in a bore for retaining it in a substantially extended and usually vertical orientation for establishing a visible post.

The implanted encased cores are then available for incorporation as gates in a slalom course. By implanting a plurality of the encased core assemblies in a ski lift line location, and attaching elongated material between the tops of the implanted assemblies, the ski area operator can easily define a selected maze for the ski lift line.

Those having normal skill in the art will recognize the foregoing and other objects, features, advantages and applications of the present invention from the following more detailed description of the preferred embodiments as illustrated in the accompanying drawings.

BRIEF DESCRIPTION OF THE DRAWINGS

FIG. 4 shows an end cap with an integral hook or eye for use with rope, tape or the like.

DETAILED DESCRIPTION OF THE PREFERRED EMBODIMENTS

Figure 1:
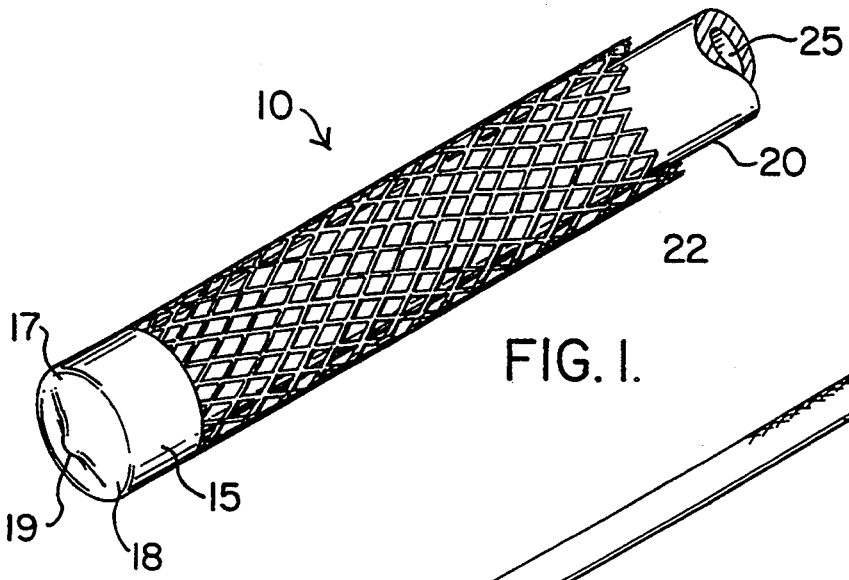
FIG. 1 is an isometric, broken view of an end portion of a yieldable post useful as a ski gate and constructed in accordance with the invention.

FIG. 1 shows the structure of a flexible post 10 in accordance with this invention which is particularly well suited for use as a ski gate as is described below. The core 20 is shown with a hollow coaxial center portion 25, although a solid tube of SPF has proven satisfactory in one model constructed in accordance with this invention. The outer diameter of core 20 is preferably around one to three inches depending upon the overall height of post 10. That is, the diameter of core 20 increases in proportion to the length of the post or gate 10. For a ski gate of eight feet, the full three inch diameter may prove advisable.

Core 20 is fabricated from a flexible, self redressing material, such as 3.2 pcf SPF, manufactured and sold by commercially available sources. This material is soft so that it will not injure a skier who runs into post 10. Despite the soft character of this material, it is flexible enough to bend easily when impacted by a ski or skier, yet quickly and reliably redresses in that it returns to its original vertical position once the force is removed. Additionally, this redressing is accomplished at the extremes of the temperature ranges encountered at typical ski areas.

Core 20 is covered by a flexible, open-mesh sleeve, 22. The flexible mesh sleeve 22 fits over the relatively soft core 20 to protect it from damage. Sleeve 22 is formed from a tough, flexible material, such as low density polyethylene. Such mesh is readily available from contemporary commercial sources.

Figure 2:
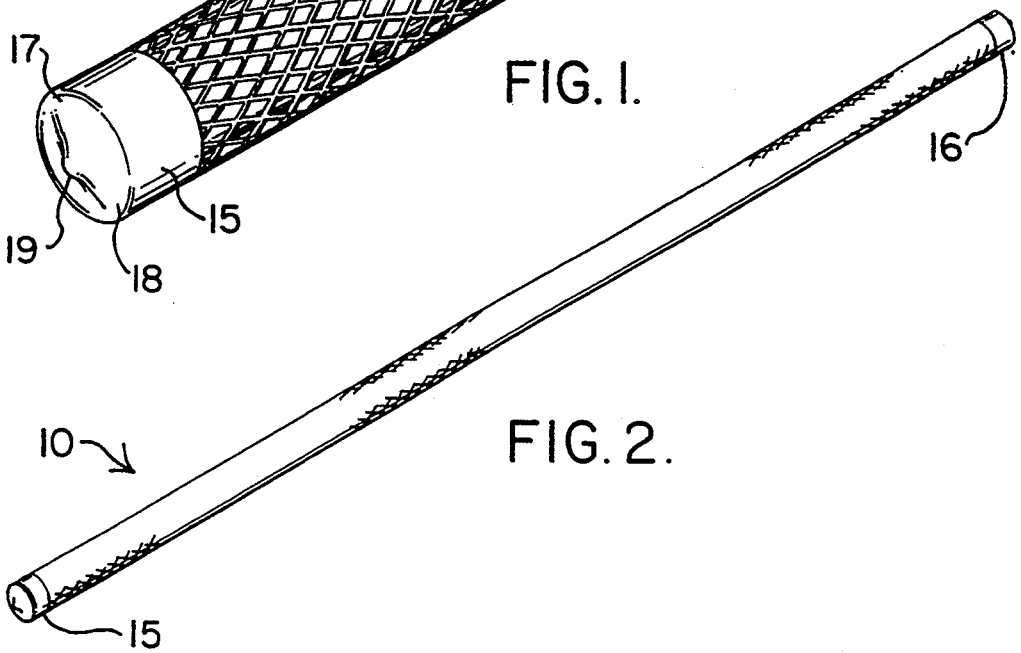
FIG. 2 is a full isometric view of the ski gate.

One end cap 15 is shown in FIG. 1, and the other end cap 16 is visible in FIG. 2. End cap 15 is also made of a tough, flexible material like low density polyethylene. The end caps are preferably formed with a slightly rounded edge 17 and shallow conical face 18 having a slight dimple 19 in the middle. For economies of manufacture, caps 15 and 16 are preferably constructed of identical materials with an identical configuration. While a flat cup-shaped cap can serve for caps 15 and 16, the slightly rounded and conical profile mentioned above has proven effective for ease of insertion of poles 10 into the holes bored in the snow.

Caps 15 and 16 are preferably one and five-eights inches in diameter for a good force fit into the one and a half inch hole typically drilled in the snow at ski areas for receiving prior art slalom poles. However, the diameter of the bore will obviously vary with the diameter of the pole, which is dependant on use. Cap 15 protects the end of the ski gate 10 from damage when it is inserted in the snow. In FIG. 2, the full pole with both end caps, 15 and 16, is shown. Its length can typically vary from approximately two feet to approximately eight feet, depending on the application.

Figure 3A:
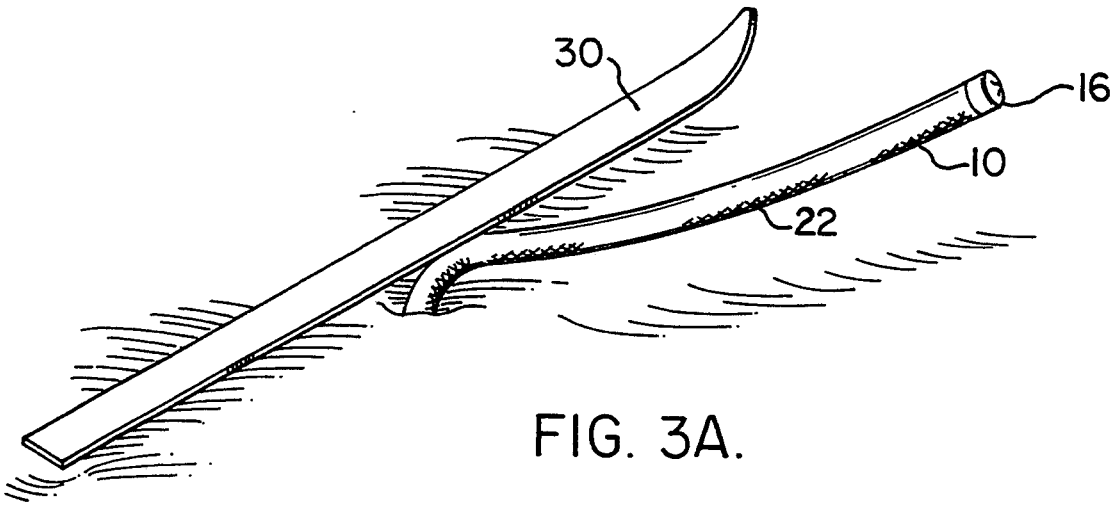
FIG. 3 is a diagram of the operation of the ski gate with FIG. 3A showing the immediate effect of impact by the ski of a skier and FIG. 3B showing the ski gate after self redressing following passage of the ski.
Figure 3B:
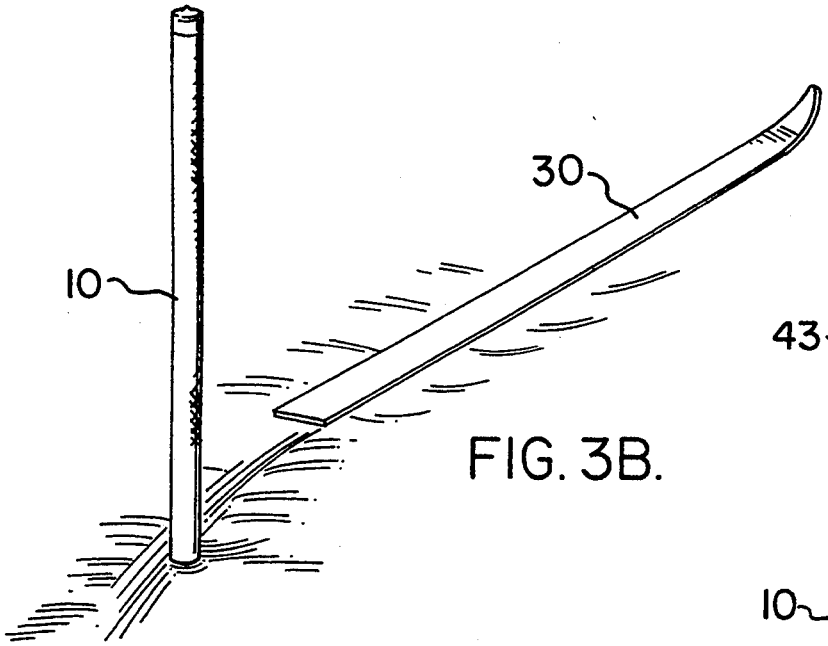

FIG. 3A shows the operation of the post 10 as a ski gate for a slalom course. As a ski 30 impacts the ski gate 10, it bends easily because the inner core 20 and protective mesh sleeve 22 are of highly flexible material. That is, if core 20 were constructed of polyethylene, it would prove too stiff to function as a slalom gate. However, the SPF material would suffer damage as from the edges of skis and therefore cannot act as the entire pole element by itself. Thus, because of its open mesh structure, mesh sleeve 22 protects the soft inner core 25 from damage by the ski 30 while not significantly discounting the redressing ability of core 20. As a result, ski gate 10 self redresses to stand in its original, vertical position after the impacting object has passed as is illustrated in FIG. 3B.

Figure 4:
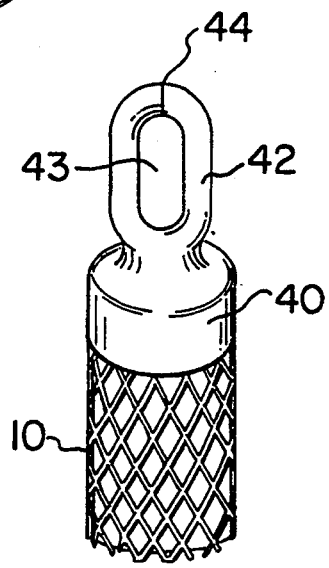

FIG. 4 shows a second embodiment of the present invention. In this embodiment, one of the end caps 40 has an eye, or hook, element 42 formed as an integral part of its structure with an opening 43 therethrough. While a solid ring for element 42 is acceptable, inclusion of a cut or slot 44 into opening 43 makes it is possible to pass a rope, string, tape or the like into opening 43 without having to thread it through opening 43. This allows rope stringing between the posts, for use in the lift-line mazes leading up to ski lifts and to mark off disabled snowcats or hazardous areas of the snow.

In many applications, a reflective material is preferably secured to the post and/or its end caps to facilitate visibility of the device especially for the headlights of a snowcat. If desired, it is acceptable to employ highly visible colors (such as International Orange) or colored materials for the elements of post 10 and, particularly, caps 15, 16 and 40, as well as open mesh sleeve 22.

Present lift-line mazes are demarcated by fixed posts which the ski area operator uses to string maze defining ropes or tape. The posts are anchored into the ground in a relatively permanent position which prevents use of a snowcat, or other mechanized equipment, from dressing the snow in the maze area when the ski area is closed. The present invention employing a FIG. 4 type of cap advantageously overcomes this problem. The ski area operator can use their standard 1.5 inch auger to drill holes in the snow and implant posts 10 with caps 40 to establish the same maze patterns as before.

Furthermore, by use of the present invention, it is now possible to remove all of the posts from within the maze area during off hours so that a snowcat can quickly dress the snow in the maze area. It is a simple matter to subsequently re-implant the posts 10 possibly without even removing the maze defining ropes. If desired, the ski area operator could utilize permanent corner posts to establish the general boundaries of the maze area as well as to provide fixed terminals for the ropes or tapes.

Figure 5:
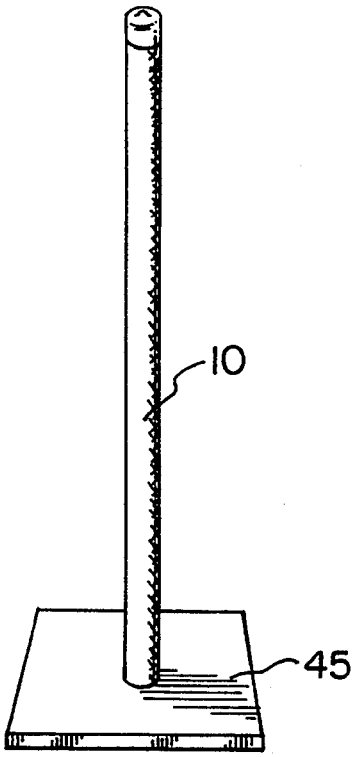
FIG. 5 shows the present invention inserted into a base.

FIG. 5 shows how a pole 10 planted in a base 45 for use as a safety marker on roads or wherever drilling of holes for receiving post 10 is not feasible or desirable. As mentioned, a feature of the invention can include reflective caps and light colored mesh such as optic orange or green to enhance visibility. Use of the present invention avoids the more expensive, dangerous and complicated hinge mechanisms of the prior art.

Figure 6:
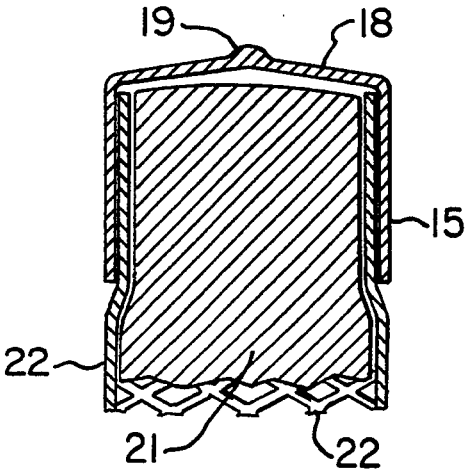
FIG. 6 is a sectioned view of an end cap for the assembled core and protective sleeve.

The assembled end of a post 10 is shown in section in FIG. 6. The difference compared to FIG. 1 is that core 21 is fabricated by a solid extrusion of 3.2 pcf SPF while the mesh sleeve 22 is likewise extruded, although of low density polyethylene. Both are cut into straight sections as they leave the extruder to avoid the curling effect often encountered for rolled products from such extrusion processes as contemporarily implemented. In the presently employed manufacturing process, sleeve 22 is formed with a slightly greater inside diameter than the outside diameter of core 21 to accommodate insertion of core 21 into sleeve 22. Core 21 might also receive a water resistant coating either before or after insertion into sleeve 22 to prevent core 21 from becoming less flexible from moisture seepage, and freezing when in use in ski areas.

While it is possible to cut the subassembly of core 20/21 and sleeve 22 to any desired length and even re-cut it to shorter lengths on site, it is believed sections which are 32 inches are an ideal length for many ski area uses although four foot long sections are somewhat more practical for manufacturing and handling purposes. It is only necessary to insert a few inches of the end of post 10 into the bore in the snow to realize adequate anchoring in view of the flexibility of the assembly.

The end of the sub-assembly is reduced slightly and forced into cap 15, as shown in FIG. 6, preferably with glue or other bonding agent included to secure it within cap 15 so that the subassembly of core 20/21 and sleeve 22 bulges outwardly somewhat as is visible in FIG. 6. This assures retention of the parts in their final configuration. Note that the same technique is employed to attach other cap configurations to the core and sleeve subassembly, such as the cap 40 in FIG. 4.

Yieldable posts, in accordance with this invention, are remarkably versatile tools for ski coaches and trainers. These gates resist hooking by skiers but are light weight while supporting a wide variety of exercises and uses for the ski coach. For example, a single coach can easily and individually set a full length slalom course almost anywhere in a ski area from a small bundle of four foot long gates. The posts renders many training drills available that were not previously possible and for the complete spectrum of student skier skills including every level of Alpine competitor.

While the exemplary preferred embodiments of the present invention are described herein with particularity, those having normal skill in the art will recognize various changes, modifications, additions and applications other than those specifically mentioned herein without departing from the spirit and scope of this invention.

What is claimed is:

1. A yieldable post suitable for use as a slalom pole, safety marker, boundary indicator or the like comprising;

an elongated one-piece, homogeneous core of a flexible, self-redressing material extending throughout substantially the entire length of said post and being capable of flexing into approximately a right angle at any point along the length of said core in response to a force applied thereto transverse to the central axis thereof and of returning to its elongated configuration upon removal therefrom of said force which caused said flexing of said core, an elongated, hollow sleeve of a flexible open mesh material which is capable of flexing with said core but which will resist impacting by an object with said sleeve internally receiving said core in close proximity thereby forming a protective covering over said core, and means retaining said core within said sleeve as an assembly whereby implantation of said assembly in a vertically retaining bore will provide a self redressing but flexible post which can withstand impact without damage thereto.

2. The post of claim 1 wherein said protective covering is formed of an open mesh, and the outside diameter of said assembly is in the range of from one inch to three inches.

3. The post of claim 1 wherein said retaining means includes end caps for receiving ends of said assembly.

4. The post of claim 3 wherein one of said end caps has an eye formed therein as integral element of said one of said caps.

5. The post of claim 1 wherein said assembly has a diameter for snugly fitting into bores of about 1.5 inch diameter.

6. The post of claim 1 wherein said core is of redressing characteristics equivalent to 3.2 pcf SPF material.

7. The post of claim 6 wherein said sleeve is of material having characteristics equivalent to a low density polyethylene in an open mesh pattern.

8. The post in accordance with claim 3 wherein said cap on at least one end of said assembly includes an opening therethrough for receiving rope-like elements.

9. The method of providing a safe marker or the like for providing a visible function comprising the steps of forming a relatively straight, elongated one-piece, homogeneous core of a flexible, self-redressing material extending throughout substantially the entire length of said post and being capable of bending to approximately a right angle at any point along the length of said core relative to the central axis of said core in response to application of a force to said core and of self redressing to said straight, elongated configuration in the absence of said force, encasing said core in am impact resistant sleeve of a flexible, open mesh material for protecting said core from damage upon impact while flexing with said core, but allowing return of said core to its relatively straight, elongated configuration after removal of an impact force from said sleeve, implanting said encased core in a bore for retaining it in a substantially extended orientation for establishing a visible post.

10. The method in accordance with claim 9 wherein said implanting step includes the step of incorporating said encased core as a gate in a slalom course.

11. The method in accordance with claim 9 which includes the step of implanting a plurality of said encased cores in a ski lift line location, and attaching elongated material between the tops of said implanted encased cores for defining a selected maze for said ski lift line.

* * * * *